US008100782B2

(12) United States Patent
Craine

(10) Patent No.: US 8,100,782 B2
(45) Date of Patent: Jan. 24, 2012

(54) LACROSSE PRACTICE DEVICE

(76) Inventor: Stefan Craine, Salida, CO (US)

( * ) Notice: Subject to any disclaimer, the term of this patent is extended or adjusted under 35 U.S.C. 154(b) by 0 days.

(21) Appl. No.: 12/606,057

(22) Filed: Oct. 26, 2009

(65) Prior Publication Data

US 2010/0105502 A1 Apr. 29, 2010

Related U.S. Application Data

(60) Provisional application No. 61/109,070, filed on Oct. 28, 2008.

(51) Int. Cl.
*A63B 69/00* (2006.01)

(52) U.S. Cl. ..... 473/425; 473/446; 473/458

(58) Field of Classification Search ..... 473/425, 473/422, 423, 424, 430, 450, 458, 464, 508, 473/446, 506; 24/67.9, 3.11, 3.12
See application file for complete search history.

(56) References Cited

U.S. PATENT DOCUMENTS 675,633 A * 6/1901 Kantrowitz et al. ..... 24/3.12
780,962 A * 1/1905 Perry ..... 24/3.11
2,512,239 A * 6/1950 Singer ..... 473/508
3,934,873 A * 1/1976 Griffin ..... 473/424
4,071,239 A * 1/1978 Ferguson ..... 473/425
4,111,419 A * 9/1978 Pellegrino ..... 473/425
D252,422 S * 7/1979 Gillenwater ..... D3/221
4,475,676 A * 10/1984 Smith ..... 224/247
4,699,303 A * 10/1987 Kline ..... 224/667
4,867,451 A * 9/1989 Mitchell ..... 473/576
4,911,442 A * 3/1990 Monroe et al. ..... 473/462
4,947,524 A * 8/1990 Chang ..... 24/67.9
5,120,055 A * 6/1992 McCarthy et al. ..... 473/425
5,309,605 A * 5/1994 Sato ..... 24/67.9
5,649,699 A * 7/1997 Todoroff ..... 473/425
D392,770 S * 3/1998 Scallon et al. ..... D27/183
5,816,945 A * 10/1998 Todd et al. ..... 473/425
5,957,819 A * 9/1999 Cortesi ..... 482/121
6,322,460 B1 * 11/2001 Asci ..... 473/422
6,458,050 B2 * 10/2002 Barry ..... 473/438
7,628,706 B2 * 12/2009 Xie ..... 473/36
2008/0248899 A1 * 10/2008 Whitten et al. ..... 473/446
2009/0291779 A1 * 11/2009 Wilton ..... 473/425
2009/0298619 A1 * 12/2009 Tice ..... 473/425

OTHER PUBLICATIONS

BakLaxBall, Retrieved from the Internet Oct. 26, 2009 http://www.wearelacrosse.com/baklax.html, 2 pages.
LaxPrax Lacrosse Rebounder, Retrieved from the Internet Oct. 26, 2009 http://laxpraxstore.com/default.aspx, 2 pages.

* cited by examiner

*Primary Examiner* — Mitra Aryanpour
(74) *Attorney, Agent, or Firm* — Lathrop & Gage LLP

(57) ABSTRACT

A lacrosse practice and/or training device allows a person to practice throwing and catching by themselves. The device includes an anchor mechanism that slides over the top of a lacrosse stick head, a cord, and a ball. A single cord connects the anchor mechanism to the stick head and the ball to the anchor mechanism, so that when the ball is thrown from the stick head, the cord stretches and then contracts, returning the ball back towards the person throwing it. The anchor mechanism is universal, for use with multiple stick heads, and it has vertical parallel braces for stabilization when on the stick head. Additionally, the release point of the cord is positioned at the top of the anchor mechanism, which is clipped onto the scoop or top of the stick head, to provide the user with a more accurate ball release and retract orientation than conventional practice devices.

18 Claims, 4 Drawing Sheets

LACROSSE PRACTICE DEVICE

RELATED APPLICATIONS

This application claims priority of provisional patent application No. 61/109,070, filed Oct. 28, 2008 and is incorporated herein by reference.

TECHNICAL FIELD

The disclosed subject matter is directed to a lacrosse practice and/or training device that allows a user to practice throwing and catching a ball by themselves, without any assistance from others.

BACKGROUND OF INVENTION

Practicing lacrosse requires numerous sessions of throwing and catching the lacrosse ball. What complicates these throwing and catching sessions, is that substantial time is spent chasing balls that are overthrown, under thrown, or simply, not caught, as successful throwing and catching sessions are reliant on both persons ability to throw and catch. When two players are throwing and catching between themselves, the ball is often under thrown or over thrown, creating wasted time retrieving the ball.

Various devices have been developed to improve the number of iterations and the ability to practice without another person such as rebounders (similar to a baseball Pitch Back® rebounder line) and other devices with cords attached to the stick head. Two such devices that use a cord to attach a ball to a stick head are marketed under the trade names BakLax and LaxPrax.

However, both rebounders and the other devices with cords attached to a ball were susceptible to problems. Rebounders, if missed with the thrown ball, also resulted in wasted time chasing the ball. Other devices with cords attached to a ball mentioned above used a Velcro® strap to attach the cord to the stick head. BakLax uses the Velcro® strap to attach the cord to the top of the stick head. The width of the Velcro® can make the device incompatible with certain mesh strung stick heads, because the Velcro® is too wide. LaxPrax uses the Velcro® strap to attach the cord to the base of the stick head (the throat). This results in a much different ball return point compared to the top of the scoop return point. These are two undesirable features for many players.

SUMMARY

The disclosed device is a lacrosse practice or training device that allows the user to practice by themselves. Additionally, the disclosed device increases the number of throws and catches a player can experience without the need for another person to practice, as the disclosed device frees a person's reliance on the others ability to throw and catch. Furthermore, the device automatically increases the number of iterations because the ball is quickly returned to the player and the ball is never overthrown or under thrown and chased after. The increased number of iterations also improves the player's hand-eye coordination.

The device is used, for example, with a lacrosse stick and ball. The device includes a mechanism that attaches to the lacrosse stick head, for example, at the scoop, and that integrates a cord and ball, allowing for increased practice iterations, improved hand-eye coordination, improved device stability, and an optimal ball release and retract point over existing practice devices. A single cord connects the anchor mechanism to the stick head and the ball to the anchor mechanism, so that when the ball is thrown from the stick head, the cord stretches and then contracts, returning the ball back towards the person throwing it. Additionally, the release point of the cord is positioned at the top of the anchor mechanism, which is attached to the scoop or top of the stick head, to provide the user with a more accurate ball release and retract orientation than conventional practice devices.

The device includes a mechanism that easily, quickly and securely attaches to a lacrosse stick head to provide an improved ball release and retract point, stability, integration with any stick head and increased impact strength compared to other attachment mechanisms. The mechanism attaches to the head of a lacrosse stick by sliding over the top of the head. The mechanism is detachable and is easily transported, and universal, for use with multiple lacrosse sticks. The mechanism allows for increased accuracy of throwing and catching a lacrosse ball, as well as allowing for rapid catching motions that improve hand-eye coordination and "soft hands," e.g. the ability to catch the ball softly so that it does not rebound off or pop out of the stick head.

An embodiment of the disclosed subject matter is directed to a mechanism that fits over the scoop or top of a lacrosse stick head, and where a cord attaches to the mechanism and to a lacrosse ball. The mechanism includes a hole at the top to thread the cord through it, a channel on the back side of the front of the mechanism to let the cord sit unencumbered by the stick head, vertical parallel braces on the back side of the front of the mechanism to stabilize the mechanism on any stick head, and a funnel channel on the back side of the back of the mechanism to secure one end of the cord. The resultant mechanism has improved strength, resistance to impact, integration with any stick head, stability with any stick head and an optimal cord release and retraction point.

In an embodiment, a lacrosse training device includes a member for anchoring to the head of a lacrosse stick, the member having a body including an open end and a cavity in communication with the open end, for engaging the head of the lacrosse stick. The body includes a first side and a second side, and an inner surface common to the first and second sides. At least one brace member extends from the inner surface at the first side, and at least one aperture in the first side extends between an outer surface of the first side and the inner surface. At least one channel receives a cord at the second side.

In an embodiment, a lacrosse apparatus includes a lacrosse stick having a head in communication with a shaft; and a member along at least a portion of the head. The member includes a body with at least one open end and a cavity in communication with the open end, an inner surface proximate the head of the lacrosse stick and an outer surface, a first side and a second side between the inner and outer surfaces, and at least one brace member extending from the inner surface at the first side. At least one aperture in the first side extends between the outer surface and the inner surface. At least one second-side channel receives a cord at the second side.

In an embodiment, a lacrosse training device includes a member for anchoring to the head of a lacrosse stick. The member has a unitary, horseshoe-shaped body with an open end, two open sides and a cavity therebetween, for engaging the head of the lacrosse stick. Front and back sides of the body have common inner and outer surfaces. Parallel brace members extend from the inner surface at the front side, and an inner channel between the parallel brace members accommodates a cord. At least one aperture in the front side extends through the outer surface and opening into the inner channel, and accommodates the cord. An outer channel in the outer surface at the back side receives an end portion of the cord.

BRIEF DESCRIPTION OF THE DRAWINGS

Attention is now directed to the drawing Figures, where like or corresponding numerals indicate like or corresponding components. In the drawings.

DETAILED DESCRIPTION

In this document, references are made to directions, such as upper, lower, top, bottom, up, down, upward, downward, front, rear, side, lateral, right, left, inner, outer, inside, outside, and variations thereof. These directional references are exemplary, to show the disclosed subject matter in an example orientation, and are in no way limiting.

Figure 1:
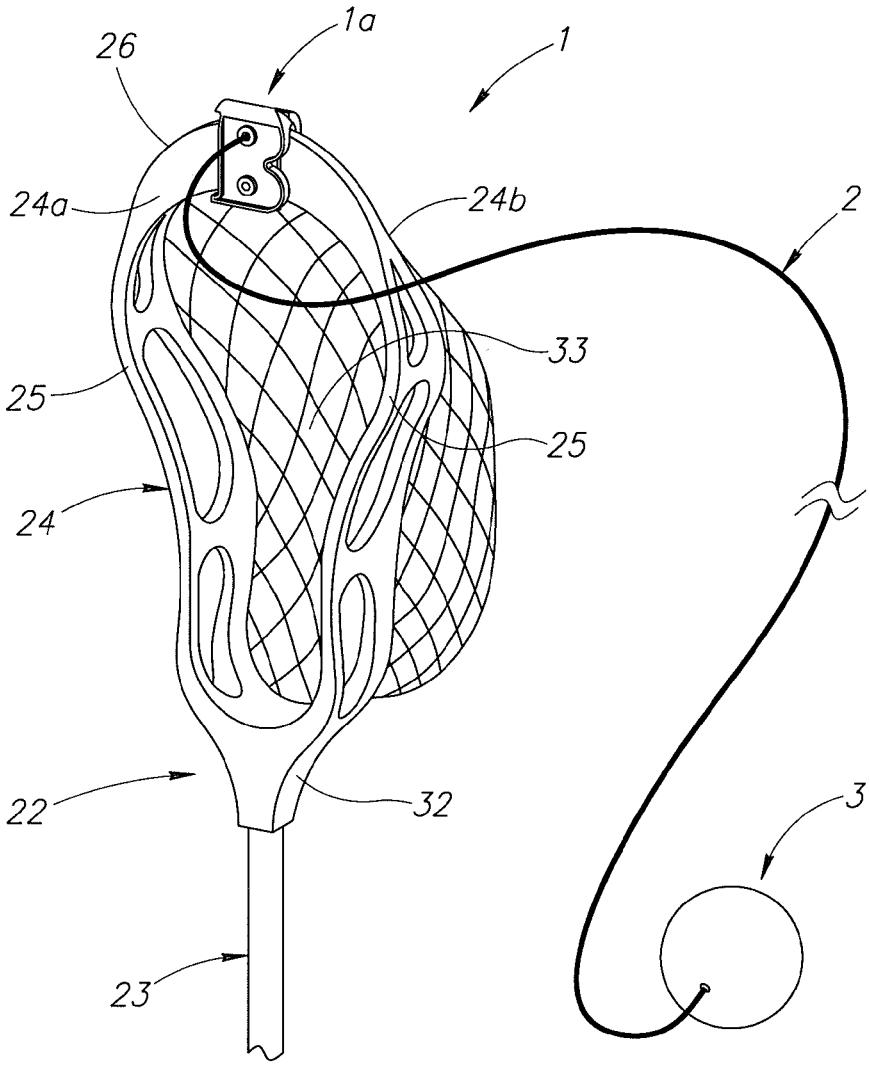
FIG. 1 is a perspective view of the disclosed device in an exemplary system for an exemplary use.

As shown in FIG. 1, a device 1 allows a player to practice passing (throwing), catching, and shooting by themselves. Device 1 includes an anchor mechanism 1*a*, for use on a lacrosse stick 22, formed, for example, of a shaft 23 and a head 24, with head 24 made of substantially rigid polymeric material. Anchor mechanism 1*a* slides over and attaches to head 24, over front 24*a* and rear 24*b* sides, for example, at a scoop 26 (top or upper portion). Scoop 26 terminates in sidewalls 25 of head 24, and sidewalls 25 terminate at a throat 32 (or lower portion) of head 24. Throat 32 joins with shaft 23. A pocket 33 of mesh material attaches to head 24. A flexible cord 2 attaches to anchor mechanism 1*a*, and a ball 3, similar or identical to a regulation lacrosse ball, is attached to cord 2 (at the end designated 2*a*).

Figure 2A:
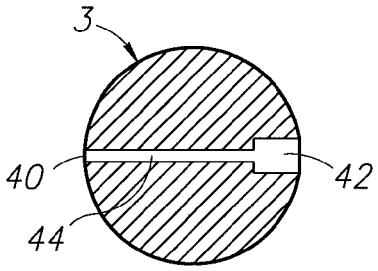
FIGS. 2A and 2B are cross sectional views of the ball used with the disclosed device and system.
Figure 2B:
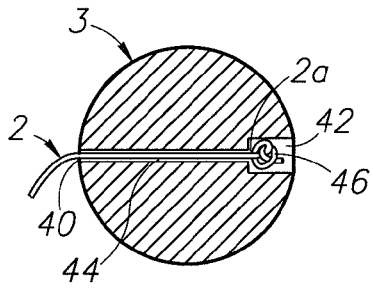
Figure 3:
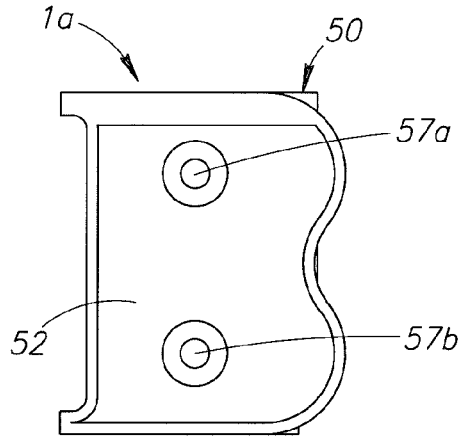
FIG. 3 is a front view of the disclosed device.
Figure 4:
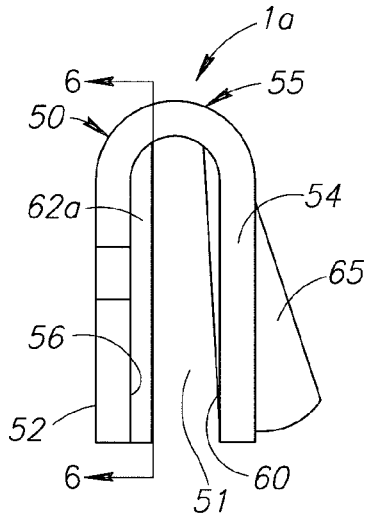
FIG. 4 is a side view of the disclosed device.
Figure 5:
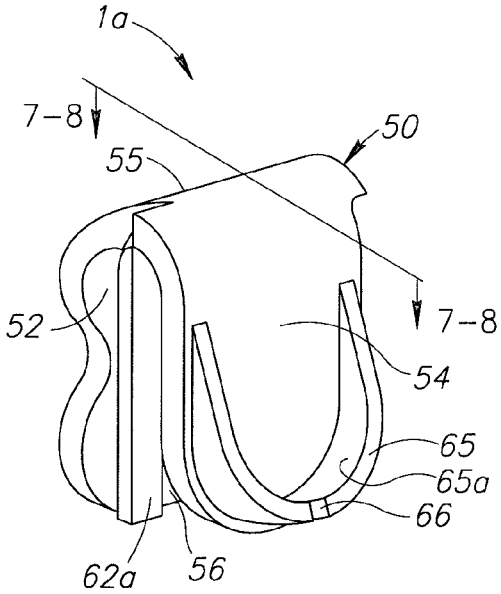
FIG. 5 is a rear perspective view of the disclosed device.
Figure 6:
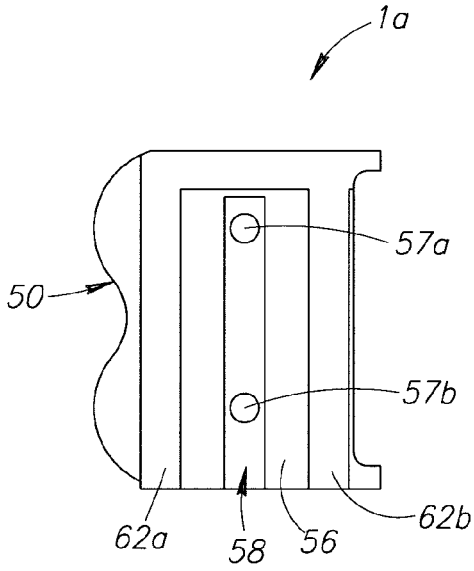
FIG. 6 is a sectional view of the disclosed device taken along line 6-6 of FIG. 4.

Turning to FIGS. 2A and 2B, ball 3 is shown, without cord 2 (FIG. 2A) and with cord 2 (FIG. 2B).

Ball 3 includes a small diameter opening 40 and a large diameter opening 42, with a bore 44, of a diameter sufficient to accommodate cord 2, for example, in a frictionally snug manner, extending between the aforementioned openings 40, 42. Cord 2 is knotted 46 at its end 2*a* at large diameter opening 42, to keep ball 3 attached to cord 2. Should ball 3 detach from cord 2, cord 2 may be slid through bore 44, from small diameter opening 40 to large diameter opening 42, with end 2*a* of cord 2 then knotted. Ball 3 may then be pulled toward knot 46 to remove any slack in cord 2, and cord 2 rests in the bore 44.

Cord 2 may be made of various materials, for example, polypropylene shock cord. Other suitable materials for cord 2 include elastic, polyester shock cord, cotton shock cord, and rubber shock cord. Cord 2 may be any desired length, for example, anywhere from 3-15 feet.

Ball 3 may be the size of a regulation lacrosse ball, although other spherical sizes are also suitable. Ball 3 may be made of materials of a regulation lacrosse ball, or may be made of materials such as rubber, foam, wood, metal, plastic and Styrofoam. Bore 44 is for example approximately 0.2 inches in diameter, and approximately 2 inches in length. Small diameter opening 40, may be, for example, the same diameter as bore 44, while large diameter opening 42, may be, for example, approximately 0.48 inches in diameter, and approximately 0.46 inches long. The larger diameter of large diameter opening 42 allows the widened surface to serve as a stop surface or limit of travel for knot 46, such that knot 46 will not move into bore 44, keeping ball 3 from detaching from cord 2.

Turning to FIGS. 3-6, anchor mechanism 1 a includes a body 50, that is, for example, horse shoe-like in shape, with an open cavity 51 to engage head 24. Mechanism 1*a* has a first or front side 52, a second or rear side 54 and a joining portion 55. An interior surface 56 is common to first side 52, second side 54 and joining portion 55.

Figure 7:
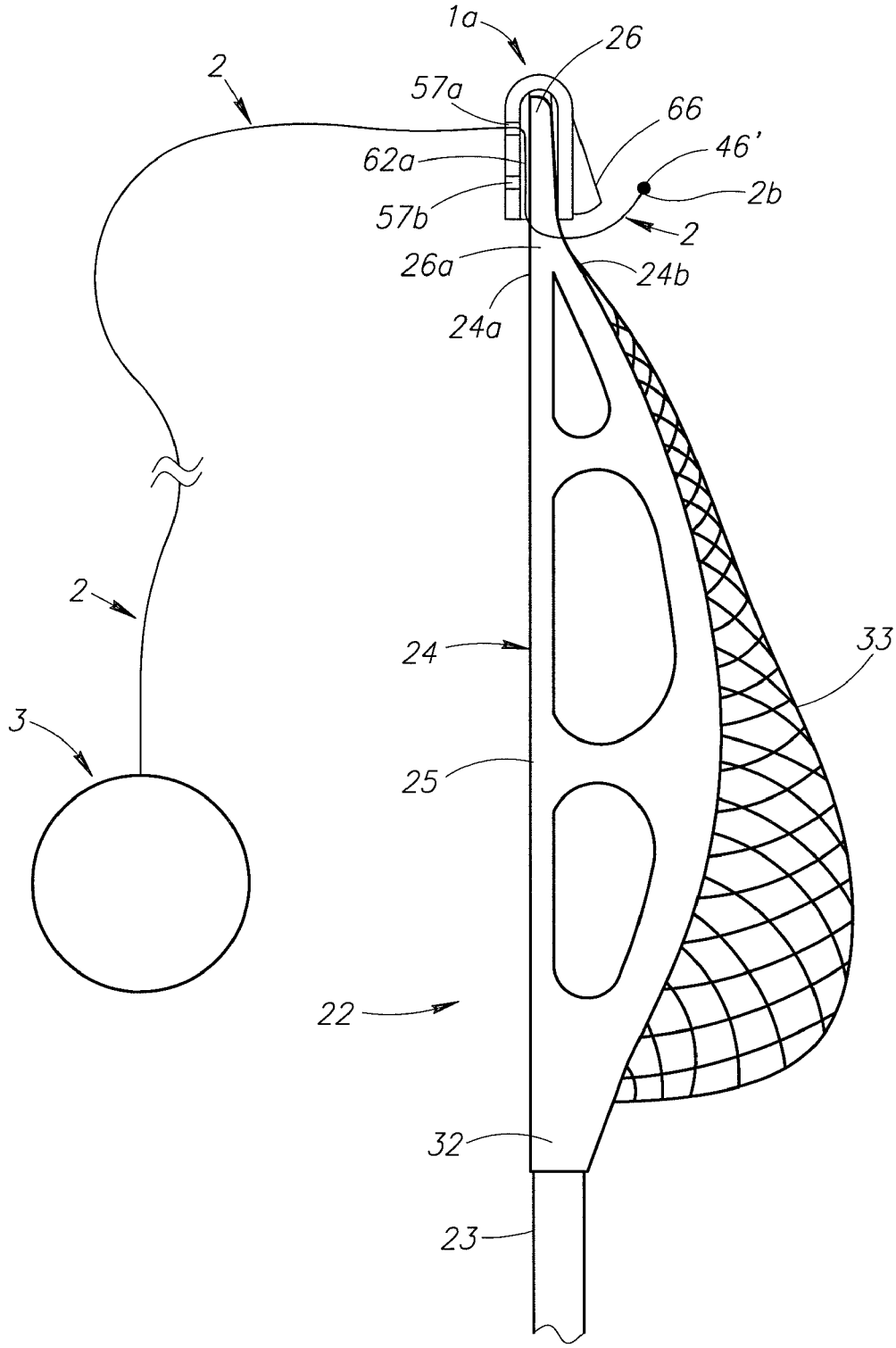
FIG. 7 is a side view of the disclosed device during attachment of the anchor mechanism.

First or front side 52 of body 50 includes, for example, two apertures 57*a* (upper), 57*b* (lower) that extend through first or front side 52 and are on a common channel 58, along interior surface 56 of first side 52. Braces 62*a*, 62*b* along the interior of first side 52 (for example, parallel to each other, and protruding from the interior surface 56) serve to allow anchor mechanism 1*a* to sit flush on scoop 26 of head 24. Braces 62*a*, 62*b* raise anchor mechanism 1*a* off of scoop 26 to take pressure off of cord 2 (FIG. 7). First or front side 52 may form a symbol. For example, front side 52 is shown forming a "B", but may also form letters including, S, W, R, and G or letters grouped together, such as STX®, BRINE®, GAIT®, Warrior®, DeBeer®, Under Armour®, Nike®, Adidas®, Reebok® or other leading manufacturers of lacrosse equipment, as well as ovals, squares and the like, provided that cord 2 is accommodated (for example, apertures 57*a*, 57*b*, channel 58 and braces 62*a*, 62*b* are included).

Figure 8:
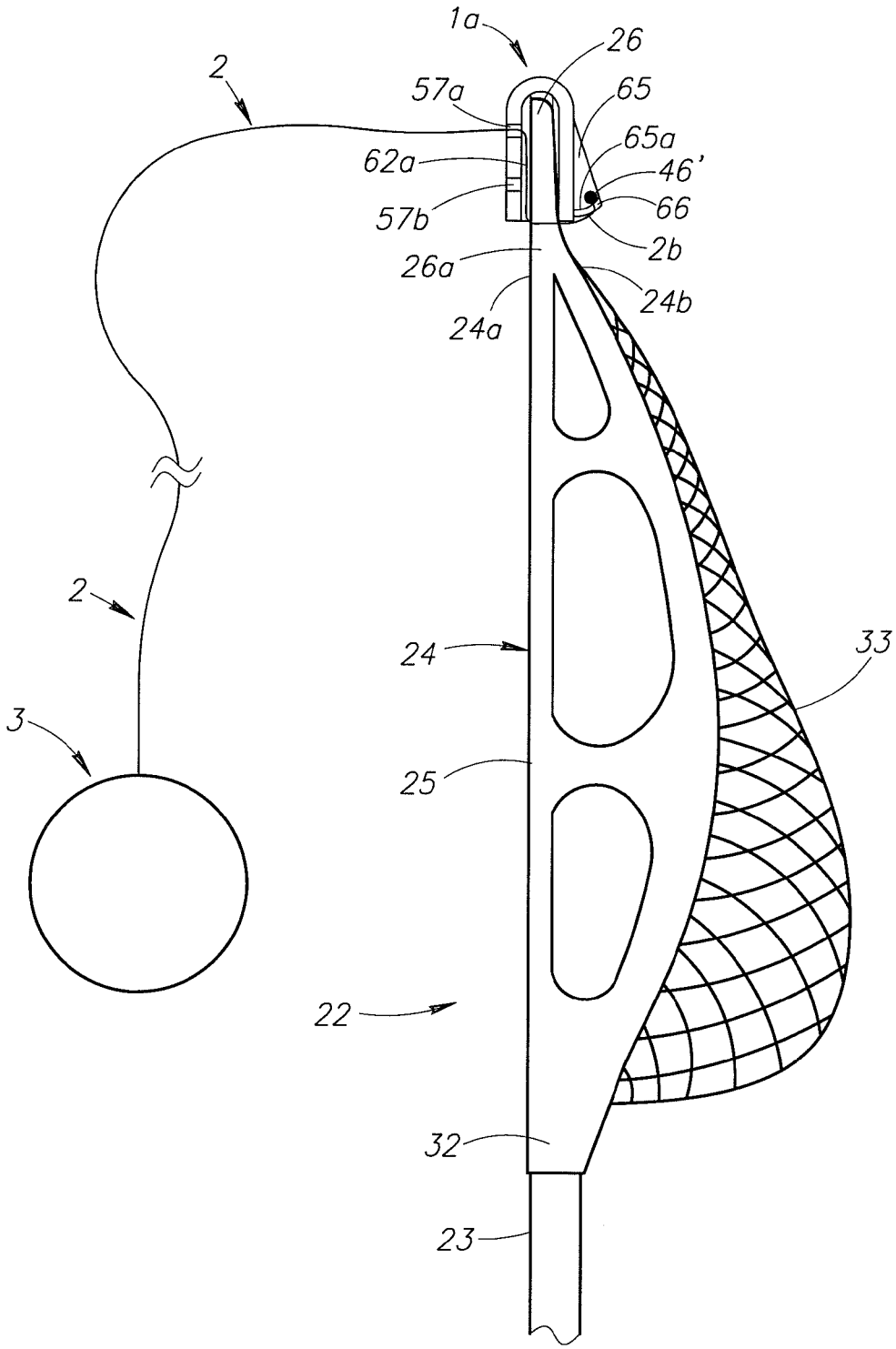
FIG. 8 is a side view of the disclosed device with attachment of the anchor mechanism complete and the lacrosse stick with the attached anchor mechanism ready for use.

Rear side 54 includes a shelf 65 (with a surface 65*a*) with a funnel channel 66 extending therethrough. The funnel channel 66 is, for example, a cylindrical shaped cut-out, of a diameter for accommodating cord 2 in a frictionally tight, yet movable manner. In operation, as detailed below, cord 2, at its end 2*b* is placed into funnel channel 66, with knot 46' at end 2*b* for abutment with surface 65*a*, to keep cord 2, and ultimately ball 3, held on anchor mechanism 1*a* (as shown in FIG. 8).

Anchor mechanism 1*a* is, for example, a unitary member, that is, for example, resilient, and made of materials, such as plastic, including plastics of high impact Acetyl resin, formed by conventional plastic forming techniques such as injection molding. Other suitable materials include metal, wood, and the like.

In an exemplary operation, as shown in FIG. 7, anchor mechanism 1*a* is attached to head 24 of a lacrosse stick 22, for example, at scoop 26, as follows. Cord 2, at its end 2*b* is slid through front side 52, through aperture 57*a* into channel 58. The tip of cord end 2*b* is knotted, and as such includes a knot 46', similar to the knot 46 at the other (opposite) end 2*a* of cord 2. Cord 2, at its end 2*b*, is pulled downward through channel 58, and can be viewed through aperture 57*b*. Anchor mechanism 1*a* is then slid over scoop 26 of head 24, until it sits flush on head 24. Cord 2 is pulled under scoop 26 of head 24 rearward, toward rear side 54 of anchor mechanism 1*a*. Cord 2, with its knotted 46' end 2*b*, is inserted into funnel channel 66, with knot 46' being positioned on or slightly above shelf 65.

Cord 2 is then pulled tight from front side 52 of anchor mechanism 1*a*, through upper aperture 57*a*. This allows for ball 3, via cord 2, to be held firmly by anchor mechanism 1*a*, as show in FIG. 8. Lacrosse stick 22, with attached anchor mechanism 1*a*, is ready for self throwing and catching by a user.

While preferred embodiments have been described, so as to enable one of skill in the art to practice the disclosed subject matter, the preceding description is intended to be exemplary only. It should not be used to limit the scope of the disclosed subject matter, which should be determined by reference to the following claims.

What is claimed is:

1. A lacrosse training device for attaching to a head of a lacrosse stick, comprising:

a body having a shape and size for anchoring to the head, the body including:

a front portion and a back portion opposing each other across a scoop of the head when anchored to the head;

an inner surface common to and connecting the front and back portions, the inner surface for securely fitting with the head;

an outer surface common to and connecting the front and back portions;

at least one aperture in the front portion, the aperture extending between the inner and outer surfaces at the front portion, the aperture having an opening size sufficient for allowing a cord to pass therethrough; and at least one funnel channel on the outer surface at the back portion, wherein the funnel channel extends through a shelf extending from the outer surface of the back portion.

2. The lacrosse training device of claim 1, additionally comprising a cord attached to the body, and a ball attached to the cord.

3. The lacrosse training device of claim 1, wherein the body is substantially horse-shoe shaped.

4. The lacrosse training device of claim 1, wherein the body is u-shaped.

5. The lacrosse training device of claim 1, wherein the funnel channel comprises a cylindrical shaped cut-out with a diameter selected for accommodating a cord attached to the body in a frictionally tight yet movable manner.

6. The lacrosse training device of claim 1, wherein the front portion forms a symbol viewable when the device is attached to the lacrosse stick.

7. The device of claim 1, the body further comprising at least one vertical brace member extending from the inner surface along the front portion generally in a longitudinal direction of the lacrosse stick.

8. The lacrosse training device of claim 7, wherein the at least one vertical brace member includes two vertical brace members.

9. The lacrosse training device of claim 8, the two vertical brace members being parallel to each other and protruding from the inner surface proximate the front portion; wherein the brace members raise the body off the head of the lacrosse stick to reduce pressure on the cord in a channel formed between the vertical brace members.

10. A lacrosse training system, comprising:

a lacrosse stick including a head in communication with a shaft along a bottom portion of the head; and a training member positioned a top portion of the head opposite to the bottom portion of the head with respect to the shaft, the training member comprising:

a body having a front side and a back side with respect to the top portion of the head;

an inner surface connecting the front side and the back side and disposed proximate to the top portion of the head;

an outer surface, an outer surface also connecting the front side and the back side, the outer surface opposing the inner surface across the body with respect to the top portion of the head;

at least one vertical brace member disposed on the front side along the inner surface, the vertical brace member extending a longitudinal direction of the lacrosse stick;

at least one aperture in the front side, the aperture extending between the outer surface and the inner surface; and at least one funnel channel on the outer surface at the back side, the funnel channel comprising a second aperture or a slot in a rear shelf extending from the outer surface at the back portion; and a cord having a cord length and at least one knotted end, the cord length disposed through the at least one aperture in the front side of the body and the at least one knotted end secured to the funnel channel on the back side of the body.

11. The lacrosse training system of claim 10, wherein the at least one vertical brace member includes two brace members.

12. The lacrosse training system of claim 11, further comprising a front-side channel for receiving the cord at the front side; the front-side channel positioned between the two brace members; wherein the at least one aperture extends through the front side into the front-side channel.

13. The lacrosse training system of claim 10, additionally comprising a ball attached to the cord.

14. The lacrosse training system of claim 13, wherein the cord extends through the at least one aperture in the front side and into a front-side channel in the inner surface at the front side; the two vertical brace members comprising parallel members flanking sides of the front-side channel; the brace members raising the training member from the head of the lacrosse stick to reduce pressure on the cord in the front-side channel.

15. The lacrosse training system of claim 13, wherein the ball comprises a variable-diameter bore therethrough; the bore having a small diameter opening and a large diameter opening; the variable-diameter bore serving to limit travel of the cord through the bore, when the cord is threaded through the bore from the small diameter opening to the large diameter opening and knotted.

16. The lacrosse training system of claim 10, wherein the body is substantially horse-shoe shaped.

17. A lacrosse training device for anchoring to the a head of a lacrosse stick, the training device comprising:

a unitary, U-shaped body, having a top portion, a front portion, and a back portion, the body having a shape and size for engaging the top, front, and back portions around at least part of a cross-section of the head;

inner and outer surfaces respectively common to and connecting the top, front, and back portions;

brace members disposed in a direction substantially parallel to a longitudinal handle of the lacrosse stick, the brace members extending from the inner surface at the front portion;

an inner channel in the front portion along the inner surface, the inner channel disposed between the brace members substantially parallel with the brace members;

at least one aperture in the front portion, the aperture connecting the inner and outer surfaces and disposed along the inner channel; and a funnel channel on the back portion along the outer surface, the funnel channel comprising a second aperture or a slot in a rear shelf extending from the outer surface at the back portion.

18. The system of claim 10, wherein the training member and the cord, when engaged, together completely surround a cross-section of the top portion of the head.

* * * * *